US009576757B2

(12) United States Patent
Opfer

(10) Patent No.: US 9,576,757 B2
(45) Date of Patent: Feb. 21, 2017

(54) CIRCUIT INTERRUPTERS WITH AIR TRAP REGIONS IN FLUID RESERVOIRS

(71) Applicant: S&C Electric Company, Chicago, IL (US)

(72) Inventor: John C. Opfer, Chapel Hill, NC (US)

(73) Assignee: S&C ELECTRIC COMPANY, Chicago, IL (US)

( * ) Notice: Subject to any disclaimer, the term of this patent is extended or adjusted under 35 U.S.C. 154(b) by 131 days.

(21) Appl. No.: 14/678,060

(22) Filed: Apr. 3, 2015

(65) Prior Publication Data

US 2015/0294819 A1 Oct. 15, 2015

Related U.S. Application Data

(60) Provisional application No. 61/978,371, filed on Apr. 11, 2014.

(51) Int. Cl.

| | |
|---|---|
| ***H01H 33/666*** | (2006.01) |
| ***H01H 33/56*** | (2006.01) |
| ***H01H 33/55*** | (2006.01) |
| *H01H 9/02* | (2006.01) |
| *H01H 33/662* | (2006.01) |

(52) U.S. Cl.

CPC ..... *H01H 33/56* (2013.01); *H01H 33/55* (2013.01); *H01H 33/6661* (2013.01); *H01H 2009/0292* (2013.01); *H01H 2033/6623* (2013.01)

(58) Field of Classification Search

CPC ..... H01H 2009/0292; H01H 2033/6623; H01H 33/55; H01H 33/56; H01H 33/6661

See application file for complete search history.

(56) References Cited

U.S. PATENT DOCUMENTS 3,472,981 A 10/1969 McCarty et al.
3,522,404 A * 8/1970 Trayer ..... H01H 9/16 174/18
3,641,295 A * 2/1972 Ferton ..... H01H 33/022 218/58

(Continued)

FOREIGN PATENT DOCUMENTS

CN 201717550 U 1/2011
WO 0069041 A1 11/2000

OTHER PUBLICATIONS

United States International Searching Authority, International Search Report and Written Opinion for International Application No. PCT/US2015/025227 mailed Jul. 13, 2015.

*Primary Examiner* — Truc Nguyen
(74) *Attorney, Agent, or Firm* — Lorenz & Kopf LLP

(57) ABSTRACT

Circuit interrupting devices, power distribution switchgear assemblies, and pole units for power distribution are provided. A circuit interrupting device includes a solid insulation housing, a disconnect, a window, and an insulating fluid. The solid insulation housing defines a first external opening and a first cavity extending into the solid insulation housing from the first external opening. The disconnect has a moving contact in selective engagement with a stationary contact in the first cavity. The window is secured to the solid insulation housing at the first external opening. The insulating fluid is disposed within the first cavity. The window, the solid insulation housing, or a combination thereof is configured to form a trap region that is in fluid communication with the first cavity and is configured to trap air bubbles in the insulating fluid.

20 Claims, 6 Drawing Sheets

(56) References Cited

U.S. PATENT DOCUMENTS

| | | | | |
|---|---|---|---|---|
| 4,124,790 | A * | 11/1978 | Kumbera | H01H 33/666 200/302.1 |
| 4,461,937 | A * | 7/1984 | Boni | H01H 33/34 200/82 B |
| 6,198,062 | B1 * | 3/2001 | Mather | H01H 33/022 218/120 |
| 6,222,147 | B1 * | 4/2001 | Doughty | H01H 1/2058 218/149 |
| 6,307,172 | B1 * | 10/2001 | Bolin | H01H 33/56 174/16.2 |
| 2005/0082260 | A1 * | 4/2005 | Martin | H01H 33/027 218/118 |
| 2005/0247677 | A1 | 11/2005 | Perret | |
| 2010/0074411 | A1 | 3/2010 | Chaves | |
| 2012/0242018 | A1 | 9/2012 | Ohda et al. | |
| 2013/0153541 | A1 * | 6/2013 | Monahan | H02B 13/025 218/155 |
| 2014/0224770 | A1 * | 8/2014 | Hensberger | G01N 9/36 218/52 |

* cited by examiner

CIRCUIT INTERRUPTERS WITH AIR TRAP REGIONS IN FLUID RESERVOIRS

CROSS-REFERENCE TO RELATED APPLICATIONS

This application claims the benefit of U.S. Provisional Application No. 61/978,371 filed on Apr. 11, 2014, the entire disclosure of which is incorporated herein by reference.

TECHNICAL FIELD

This disclosure generally relates to circuit interrupters, and more particularly relates to circuit interrupters in power distribution switchgear that have air trap regions in fluid reservoirs.

BACKGROUND

Circuit interrupting devices function to isolate a fault condition in a power distribution system. Upon clearing of the fault condition certain types of these devices may be manually or automatically reclosed to restore the circuit. Faults in a power distribution system can occur for any number of reasons and are typically transient. Reclosing after the fault is cleared provides for quick service restoration.

A typical circuit interrupting device may include a disconnect having a stationary contact and a moving contact. Some such disconnects may be located within a fluid cavity and surrounded by electrically insulating or dielectric fluid, such as silicone. In certain conditions, these fluid-filled disconnects may have air bubbles within the fluid cavity. While these disconnects are still functional with such air bubbles, the air bubbles may cause technicians or other personnel to believe that the circuit interrupting device is in need of service.

Accordingly, it is desirable to provide a circuit interrupter device with a configuration capable of reducing such visible air bubbles in a silicone filled cavity. Furthermore, other desirable features and characteristics of the present invention will become apparent from the subsequent detailed description and the appended claims, taken in conjunction with the accompanying drawings and the foregoing technical field and background.

DESCRIPTION OF THE DRAWINGS

The exemplary embodiments will hereinafter be described in conjunction with the following drawing figures, wherein like numerals denote like elements, and wherein.

DETAILED DESCRIPTION

Circuit interrupting devices, power distribution switchgear assemblies, and pole units for power distribution are provided. In one embodiment, a circuit interrupting device includes a solid insulation housing, a disconnect, a window, and an insulating fluid. The solid insulation housing defines a first external opening and a first cavity extending into the solid insulation housing from the first external opening. The disconnect has a moving contact in selective engagement with a stationary contact in the first cavity. The window is secured to the solid insulation housing at the first external opening. The insulating fluid is disposed within the first cavity. The window, the solid insulation housing, or a combination thereof forms a trap region that is in fluid communication with the first cavity and is configured to trap air bubbles in the insulating fluid.

In another embodiment, a power distribution switchgear assembly includes a solid insulation housing, a disconnect, a window, and an insulating fluid. The solid insulation housing defines a first external opening and a first cavity extending into the solid insulation housing from the first external opening. The disconnect has a moving contact in selective engagement with a stationary contact in the first cavity. The window is secured to the solid insulation housing at the first external opening and the insulating fluid is disposed within the first cavity. The window and the solid insulation housing form a groove at a periphery of the window to form a trap region that is in fluid communication with the first cavity. The trap region is configured to trap air bubbles in the insulating fluid and is disposed in a portion of the first cavity that is not visible through the window from outside of the solid insulation housing.

In another embodiment, a pole unit for power distribution includes a solid insulation housing, a disconnect, a window, an insulating fluid, and a temperature compensation assembly. The solid insulation housing that defines a first external opening and a first cavity extending into the solid insulation housing from the first external opening. The disconnect has a moving contact in selective engagement with a stationary contact in the first cavity. The window is secured to the solid insulation housing at the first external opening and the insulating fluid is disposed within the first cavity. The temperature compensation assembly is configured to release from a fastened position in the pole unit and expel vaporized insulation fluid away from a viewing direction through the window in response to a fault in the disconnect.

Example embodiments will now be described more fully with reference to the accompanying drawings. There is no intention to be bound by any principle presented in the preceding background or the following detailed description.

Figure 1:
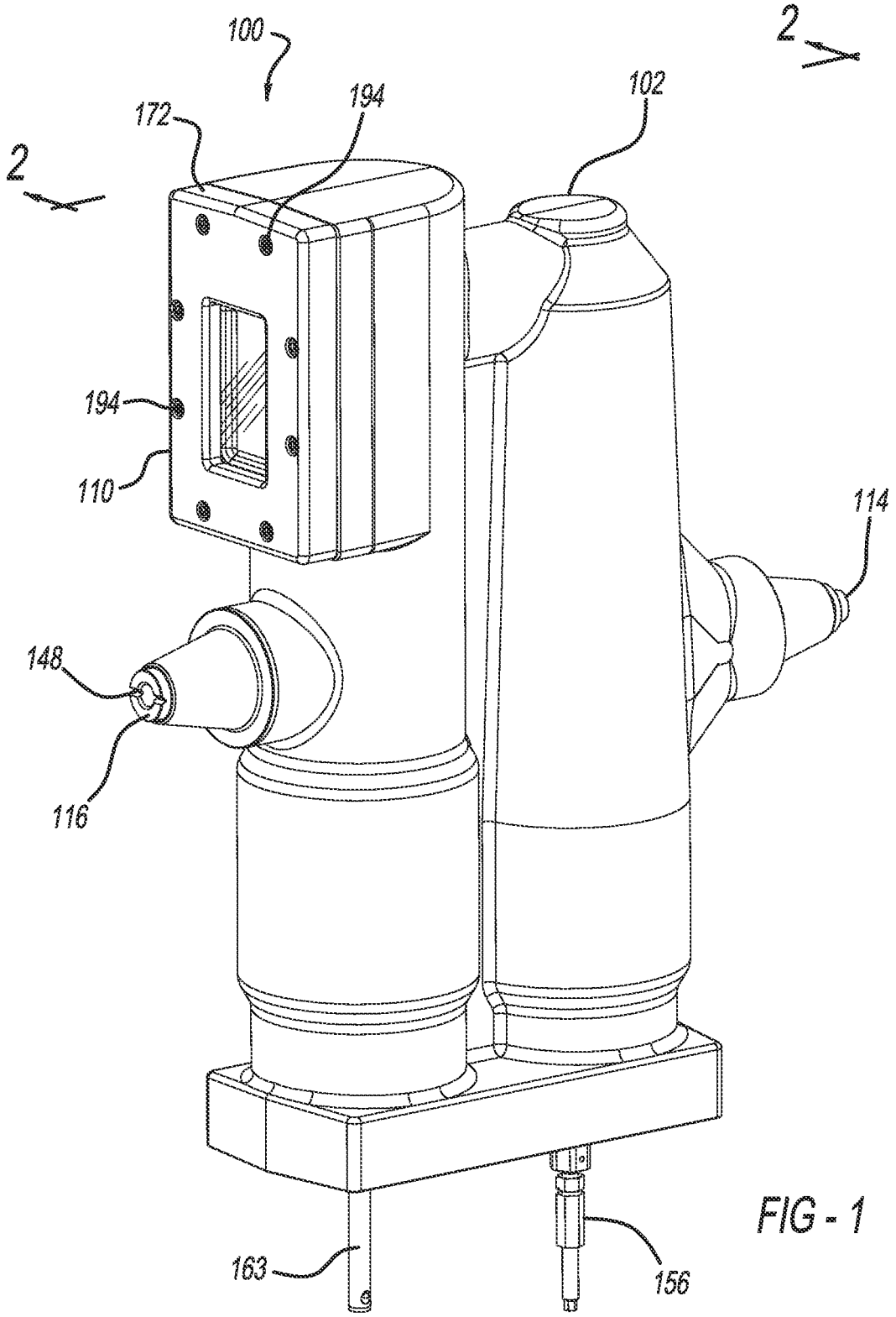
FIG. 1 is a perspective view of a circuit interrupting device in accordance with teachings of the present disclosure.
Figure 2:
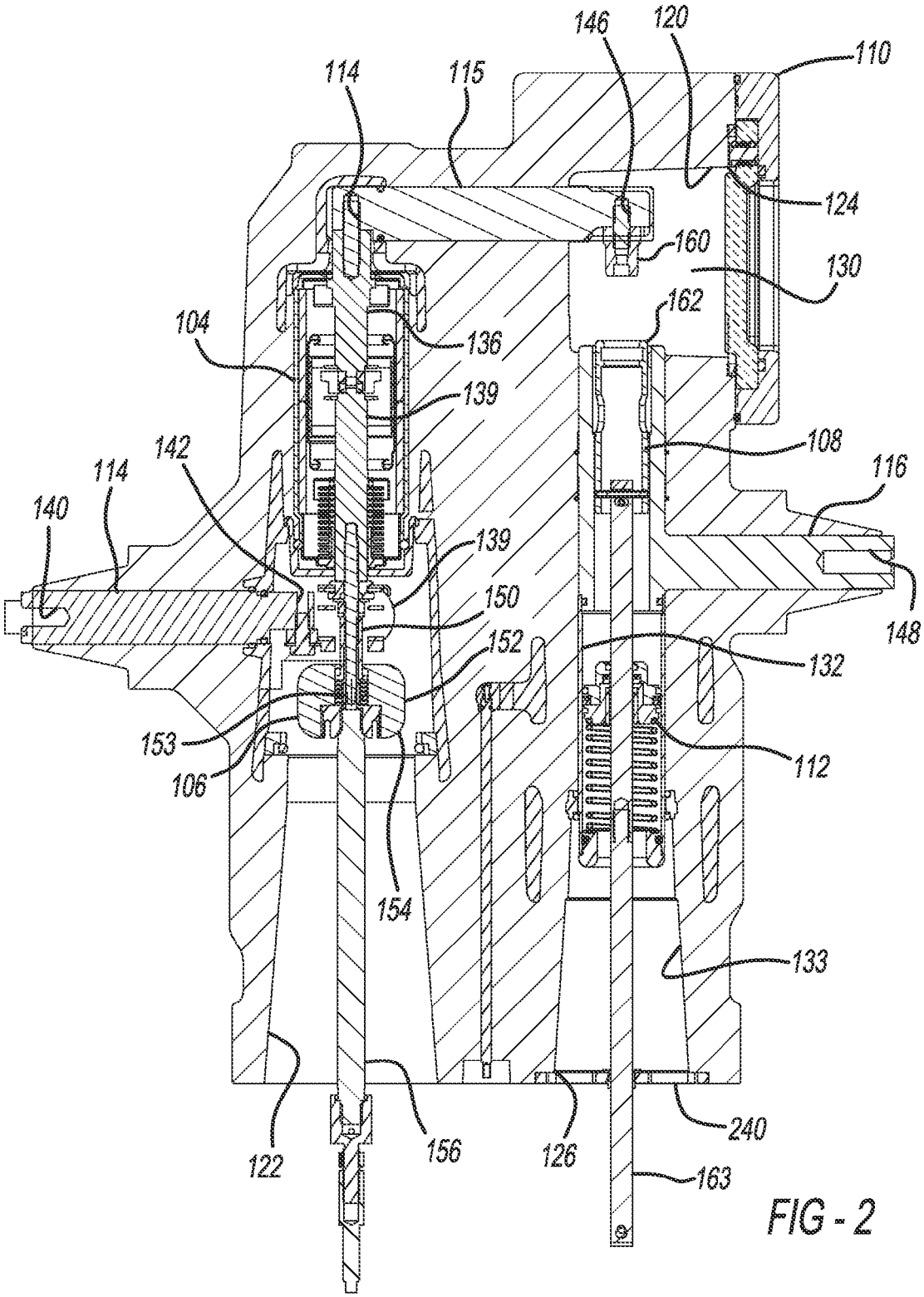
FIG. 2 is a cross-sectional view of the circuit interrupting device illustrated in FIG. 1 in the open or disconnected state.
Figure 3:
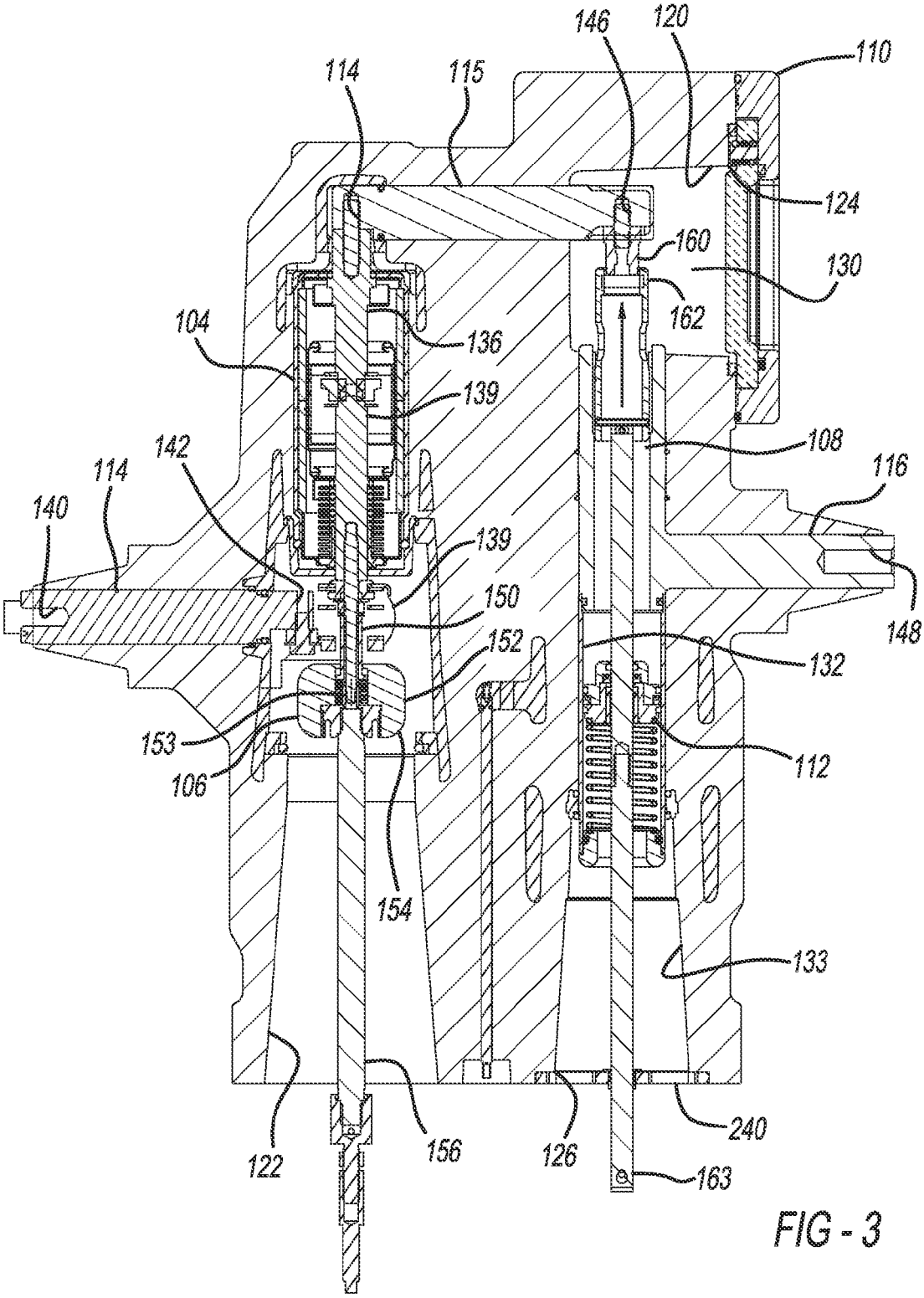
FIG. 3 is cross-sectional view similar to FIG. 2 with the circuit interrupting device illustrated in the closed or connected state.

FIGS. 1-3 illustrate an embodiment of a pole unit circuit interrupting device 100 typically used as switchgear in a power distribution system. In the example provided, circuit interrupting device 100 provides fault interruption for a single phase in power distribution switchgear. It is understood that additional devices would be included for three-phase power distribution. Circuit interrupting device 100 includes a solid insulation housing 102, a fast acting interrupter such as a vacuum interrupter 104, a contact spring assembly 106, a slow acting disconnect assembly 108, a window assembly 110, a temperature compensation assembly 112, a first external conductor 114, an internal conductor 115, and a second external conductor 116.

Solid insulation housing 102 is a molded electrically insulating or dielectric material, such as plastic. Solid insulation housing 102 is molded with a first cavity 120 and a second cavity 122. Solid insulation housing 102 may have any suitable shape, such as cylindrical, rectangular box, or an irregular shape.

First cavity 120 extends inward from a first external opening 124 through solid insulation housing 102 to a second external opening 126. First cavity 120 includes a fluid reservoir portion 130, a disconnect housing portion 132, and an expanded portion 133. Fluid reservoir portion 130 retains an electrically insulating fluid with a dielectric breakdown strength that is higher than the dielectric breakdown strength of air. The insulating fluid provides resistance to dielectric breakdown between the conductors of disconnect assembly 108 when disconnect assembly 108 is in an open position. For example, a silicone fluid or other suitable insulating fluid may be used, as will be appreciated by those with skill in the art.

In the example provided, disconnect housing portion 132 is cylindrical in shape and extends between fluid reservoir portion 130 and expanded portion 133. Disconnect housing portion 132 at least partially encloses disconnect assembly 108, second external conductor 116, and temperature compensation assembly 112. Expanded portion 133 has an increased width between disconnect housing portion 132 and second external opening 126. Second cavity 122 at least partially encloses vacuum interrupter 104 and contact spring assembly 106.

Solid insulation housing 102 further defines a recess 134 on the periphery of first external opening 124. Recess 134 is inset from an outer surface of solid insulation housing 102 to partially define a trap region for trapping air bubbles that are in the insulating fluid within the fluid reservoir. As will be described below, the trap region is located in a region that is not visible through window assembly 110 from an outside of circuit interrupting device.

Vacuum interrupter 104 is electrically coupled between first external conductor 114 and internal conductor 115 to selectively disconnect electrical current through circuit interrupting device 100. Vacuum interrupter 104 may be secured within second cavity 122 by a potting material, such as silicone or another suitable material. Vacuum interrupter 104 includes a stationary contact 136 and a moving contact 138.

Stationary contact 136 is electrically coupled with internal conductor 115 and moving contact 138 is electrically coupled with first external conductor 114 by a flexible conductor 139. As will be appreciated by those with skill in the art, current flows through vacuum interrupter 104 when vacuum interrupter is in a closed position in which moving contact 138 is in contact with stationary contact 136. Conversely, current flow through circuit interrupting device 100 is interrupted when vacuum interrupter 104 is in an open position with moving contact 138 separated from stationary contact 136. Other fault interrupters capable of interrupting the current path within a sealed enclosure and providing arc control and/or arc suppression may be used without departing from the scope of the present disclosure.

Conductors 114, 115, and 116, vacuum interrupter 104, and disconnect assembly 108 define a current path through circuit interrupting device 100, as will be appreciated by those with skill in the art. In the example provided, first external conductor 114 is a conductive rod including a first tap 140 for coupling externally of solid insulation housing 102 and a second tap 142 for fastening to flexible coupling 139. Internal conductor 115 is a conductive rod that includes a first tap 144 for fastening to stationary contact 136 and a second tap 146 for fastening to disconnect assembly 108. Internal conductor 115 is selectively electrically coupled with first external conductor 114 by vacuum interrupter 104. Internal conductor 115 is further selectively electrically coupled with second external conductor 116 by disconnect assembly 108. Second external conductor 116 is a conductive rod that includes a first tap 148 for coupling externally of solid insulation housing 102. In the example provided, first tap 140 and first tap 148 are threaded external couplings.

Contact spring assembly 106 includes an attached side 150, an unattached side 152, and a spring 153. Attached side 150 is rigidly fastened to moving contact 138 of vacuum interrupter 104. Unattached side 152 includes a mass 154 rigidly fastened to a dielectric drive rod 156. Dielectric drive rod 156 extends through second cavity 122 to couple with a drive mechanism for actuation of contact spring assembly 106 and opening of vacuum interrupter. For example, dielectric drive rod 156 may be configured to attach to a mechanical, electrical, or pneumatic actuator that is operable to pull dielectric drive rod 156 and open vacuum interrupter 104.

Disconnect assembly 108 may be any type of circuit interrupter. In the example provided, disconnect assembly 108 is a manually operated slow acting disconnect, as will be appreciated by those with skill in the art. Disconnect assembly 108 includes a stationary contact 160, a moving contact 162, and an actuation rod 163. Stationary contact 160 is fastened to second tap 146 of internal conductor 115 and moving contact 162 is in sliding engagement with second external conductor 116. Actuation rod 163 is a dielectric material that is fastened to moving contact 162 and that extends out of solid insulation housing 102 to open and close disconnect assembly 108.

Disconnect assembly 108 has an open position where moving contact 162 is separated from stationary contact 160, as illustrated in FIG. 2. Disconnect further has a closed position where moving contact 162 is engaged with stationary contact 160, as illustrated in FIG. 3. In the open position, no current flows through circuit interrupting device 100. In the closed position, current is able to flow through circuit interrupting device 100. The current position of disconnect assembly 108 may be verified by an operator of circuit disconnect assembly 108 or other viewer by observing the position of moving contact 162 through window assembly 110.

Figure 4:
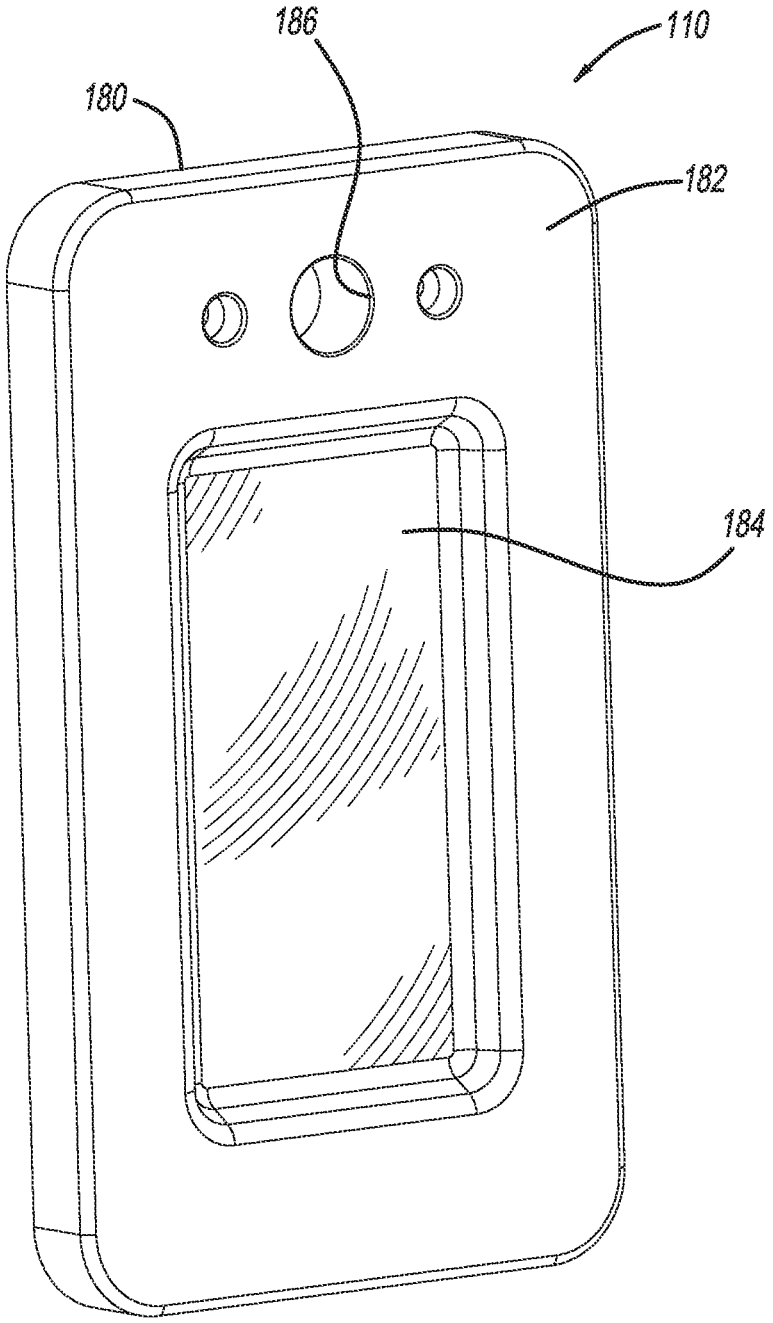
FIG. 4 is a perspective view of a window assembly of the circuit interrupting device of FIG. 1 in accordance with teachings of the present disclosure.
Figure 5:
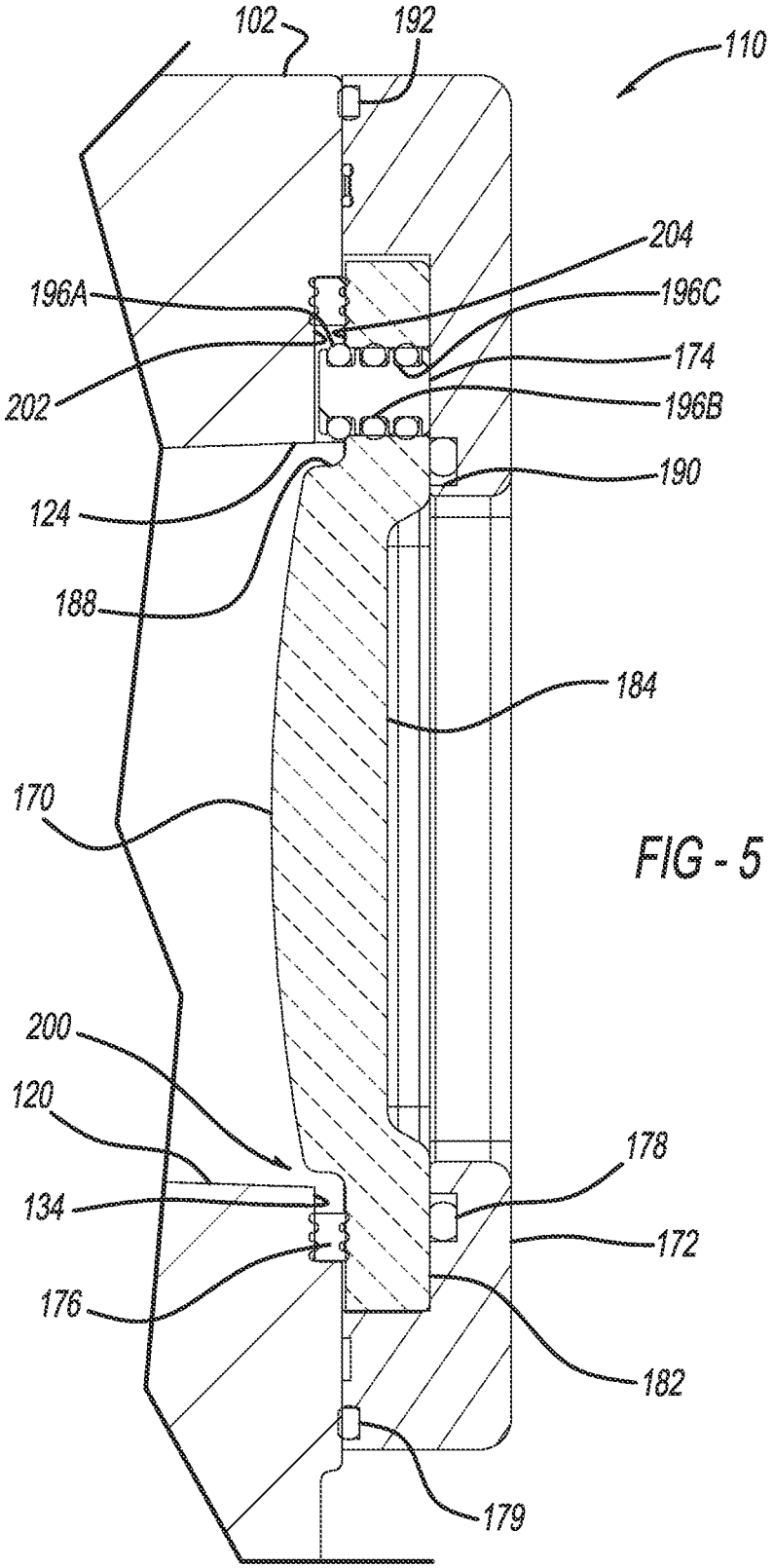
FIG. 5 is a cross-section view of the window assembly of FIG. 4 in accordance with teachings of the present disclosure.

Referring now to FIGS. 4-5, window assembly 110 is illustrated in accordance with teachings of the present disclosure. Window assembly 110 is secured to solid insulation housing 102 at first external opening 124. Window assembly 110 includes a window 170, a window retainer 172, a plug 174, a first sealing member 176, a second sealing member 178, and a third sealing member 179.

Window 170 is a transparent material disposed at first external opening 124 of solid insulation housing 102. Window 170 includes an outer flange portion 182 and an inner viewing portion 184. Outer flange portion 182 defines an aperture 186 through which fluid reservoir portion 130 may be filled during assembly of circuit interrupting device 100. Outer flange portion 182 is sealed against solid insulation housing 102 by first sealing member 176.

Inner viewing portion 184 is offset or recessed from outer flange portion 182 and extends through first external opening 124. Inner viewing portion 184 has an outer wall 188 in a transition region between inner viewing portion 184 and outer flange portion 182. In some embodiments, inner viewing portion 184 has a concave shape to direct air bubbles in the insulating fluid towards outer wall 188 and an air trap region, as will be described below.

Window retainer 172 is disposed overtop outer flange portion 182 of window 170 to secure window 170 to insulation housing 102 and retain plug 174 in aperture 186. Window retainer 172 defines a first groove 190 and a second groove 192. First groove 190 retains second sealing member 178 to seal window retainer 172 against window 170. Second groove 192 retains third sealing member 179 to seal window retainer 172 against solid insulation housing 102.

Window retainer 172 is secured to solid insulation housing 102 with fasteners 194, as can be seen in FIG. 1. In the example provided, fasteners 194 are threaded screws that exhibit a first fastening strength by which window 170 is secured against solid insulation housing 102. As used herein, a fastening strength indicates an amount of force that a connection will withstand before failing. First fastening strength is selected to be larger than a fastening strength of temperature compensation assembly 112 so that a fault causing vaporization of insulating fluid will release through temperature compensation assembly 112 rather than window 170, as will be described below.

Plug 174 is disposed within aperture 186 of window 170. Plug 174 is secured against an inner wall of aperture 186 by a first plug seal member 196A, a second plug seal member 196B, and a third plug seal member 196C. Plug seal members 196A-C circumscribe plug 174 and are separated along a longitudinal direction of plug 174. First plug seal member 196A is disposed at least partially outside of aperture 186 to seal against an edge and an inner surface of outer flange portion 182 of window 170. Second and third plug seal members 196B-C are compressed between plug 174 and a wall of aperture 186. Plug 174 is so configured to facilitate filing of fluid reservoir portion 130 during assembly.

Window assembly 110 and solid insulation housing 102 cooperate to form an air trap region 200 that is in fluid communication with first cavity 120 and is configured to trap air bubbles. Accordingly, any air bubbles trapped within the insulating fluid are directed into air trap region 200. Air trap region 200 is disposed in a portion of first cavity 120 that is not visible through window 170 from an outside of solid insulation housing 102. Accordingly, any air bubbles trapped during filling of fluid reservoir portion 130 will not be visible to technicians or other viewers who may believe that the bubbles indicate a flawed circuit interrupting device.

In the example provided, air trap region 200 is a groove in first cavity 120 at a periphery of outer flange portion 182 of window 170. Air trap region 200 includes a first sidewall 202 defined by recess 134, a second sidewall 204 defined by outer flange portion 182 of window 170, an outer portion defined by first sealing member 176, and an inner portion defined by outer wall 188 of window 170. In addition, the margin of window between flange portion 182 and inner viewing portion 184 may have an opaque or frosted treatment to conceal the air trap region 200 and any air bubbles trapped therein.

Figure 6:
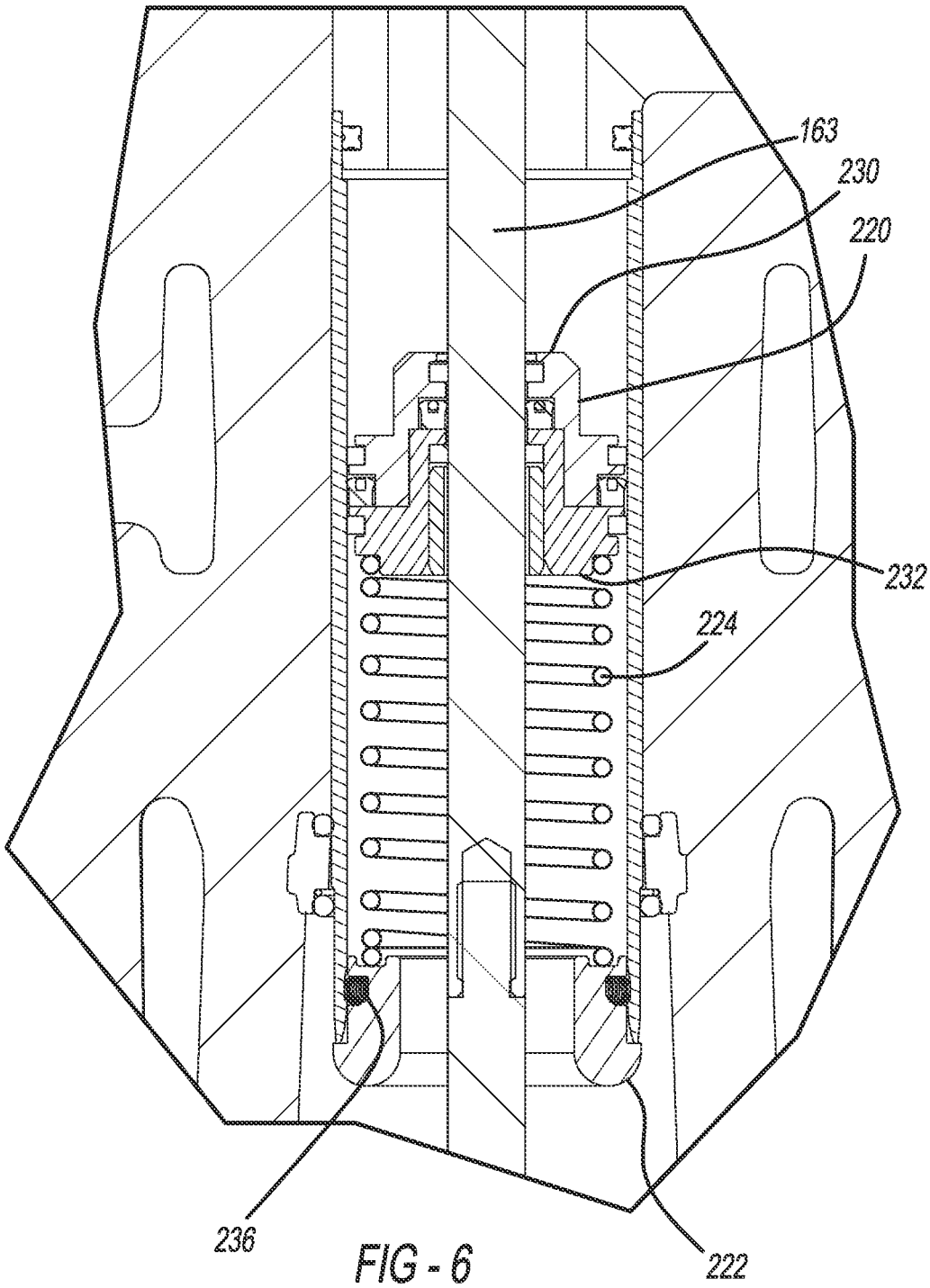
FIG. 6 is a cross-section view of an expansion compensation mechanism of the circuit interrupting device of FIG. 1 in accordance with teachings of the present disclosure.

With reference to FIG. 6, temperature compensation assembly 112 includes an expansion seal member 220, a spring seat 222, and a spring 224. Expansion seal member 220 is in sliding engagement with solid insulation housing 102 to compensate for thermal expansion and contraction of the insulating fluid within fluid reservoir portion 130. In the example provided, expansion seal member 220 is a piston having a first side 230 and a second side 232. First side 230 is in fluid communication with first cavity 120 and the insulating fluid within fluid reservoir portion 130. Second side 232 is in fluid communication with an external environment of circuit interrupting device 100. In the example provided, expansion seal member 230 is also in sliding engagement with actuation rod 163.

Spring seat 222 is configured to release from the circuit interrupting device in response to high pressure in first cavity 120 due to vaporization of the insulating fluid during a fault in disconnect 108. For example, spring seat 222 may be secured to solid insulation housing by a spring seat retaining member 236. Spring seat retaining member 236 is a latch with a second fastening strength that is less than the first fastening strength of fasteners 194 securing window 170 against solid insulation housing. Spring 224 is disposed between spring seat 222 and second side 232 of expansion seal member 230 to bias expansion seal member 230 against the insulating fluid. Accordingly, temperature compensation assembly 112 maintains pressure on the insulating fluid over the operating temperature range of circuit interrupting device 100. This pressure causes any air in the fluid to remain dissolved in the fluid rather than form visible air bubbles.

Spring seat 222 is configured to release from solid insulation housing 102 and release overpressure from circuit interrupting device 100 away from a viewing direction through window 170. In the example provided, spring seat 222 ejects downward in FIG. 6 and FIG. 1, whereas the viewing direction is to the right on FIG. 1. Such a configuration provides reduced damage to the housing 102 in the event of a fault in disconnect assembly 108 creates an arc that heats and/or vaporizes the insulating fluid.

As can be seen in FIGS. 2-3, a member 240 is fastened to solid insulation housing 102 at second external opening 126. Member 240 restricts spring seat 222 from ejecting entirely from solid insulation housing 102. In the event of a fault in disconnect assembly 108 that causes vaporization of the insulating fluid within first cavity 120, the high pressure vaporized fluid will cause spring seat retaining member 236 to release and eject spring seat 222. Spring seat 222 and expansion seal member 220 eject from the fastened position in disconnect housing portion 132 into expanded portion 133 and are retained by member 240. Any liquid or vaporized insulating fluid is able to escape insulation housing 102 around expansion seal member 220 due to the expanded dimensions of expanded portion 133. Such a configuration provides a failure mode that is preferable to failure of fasteners 194.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

I claim:

1. A circuit interrupting device, comprising:

a solid insulation housing that defines a first external opening and a first cavity extending into the solid insulation housing from the first external opening;

a disconnect having a moving contact in selective engagement with a stationary contact in the first cavity;

a window secured to the solid insulation housing at the first external opening; and an insulating fluid disposed within the first cavity, and wherein at least one of the window and the solid insulation housing is configured to form a trap region that is in fluid communication with the first cavity and is configured to trap air bubbles in the insulating fluid.

2. The circuit interrupting device of claim 1, wherein the window and the solid insulation housing form a groove at a periphery of the window as the trap region.

3. The circuit interrupting device of claim 2, wherein the window has an outer flange portion that defines a first sidewall of the groove, and wherein the solid insulation housing has a recess around the periphery of the first external opening that defines a second sidewall of the groove.

4. The circuit interrupting device of claim 1, wherein the trap region is disposed in a portion of the first cavity that is not visible through the window from an outside of the solid insulation housing.

5. The circuit interrupting device of claim 1, further comprising a sealing member disposed between the solid insulation housing and the window, wherein the sealing member defines an outer portion of the trap region.

6. The circuit interrupting device of claim 1, wherein the window has an outer flange portion and an inner viewing portion that is offset from the outer flange portion and extends through the first external opening to form an inner portion of the trap region.

7. The circuit interrupting device of claim 6, further comprising a plug, wherein the outer flange portion of the window defines an aperture in which the plug is disposed.

8. The circuit interrupting device of claim 7, further comprising a first plug seal member disposed on the plug and a second plug seal member disposed on the plug, wherein the second plug seal member is sealed against an inner wall of the aperture and the first plug seal member is sealed against an edge of the aperture within the trap region.

9. The circuit interrupting device of claim 1, further comprising a window retainer member secured to the solid insulation housing, wherein an outer flange portion of the window is disposed between and sealed to each of the window retainer member and the solid insulation housing.

10. The circuit interrupting device of claim 1, further comprising an expansion seal member in sliding engagement with the solid insulation housing and having a first side and a second side, wherein the first side is in fluid communication with the first cavity and the second side is in fluid communication with an external environment of the circuit interrupting device for accommodating thermal expansion and contraction of the insulating fluid.

11. The circuit interrupting device of claim 10, further comprising a spring seat and a spring biased between the spring seat and the second side of the expansion seal member, and wherein the spring seat is configured to release from the circuit interrupting device in response to high pressure in the first cavity due to vaporization of the insulating fluid during a fault in the disconnect.

12. The circuit interrupting device of claim 11, further comprising a spring seat retaining member and a window retainer member, wherein the window retainer member secures the window to the solid insulation housing with a first fastening strength, and wherein the spring seat retaining member secures the spring seat to the solid insulation housing with a second fastening strength that is less than the first fastening strength.

13. The circuit interrupting device of claim 1, further comprising a temperature compensation assembly configured to release from a fastened position in the solid insulation housing and expel vaporized insulation fluid away from a viewing direction in which a viewer is able to see the moving contact of the disconnect through the window.

14. The circuit interrupting device of claim 1, further comprising a temperature compensation assembly configured to maintain a pressure in the insulating fluid for restricting formation of air bubbles in the insulating fluid.

15. A power distribution switchgear assembly, comprising:

a solid insulation housing that defines a first external opening and a first cavity extending into the solid insulation housing from the first external opening;

a disconnect having a moving contact in selective engagement with a stationary contact in the first cavity;

a window secured to the solid insulation housing at the first external opening; and an insulating fluid disposed within the first cavity, and wherein the window and the solid insulation housing form a groove at a periphery of the window to form a trap region that is in fluid communication with the first cavity and is configured to trap air bubbles in the insulating fluid, wherein the trap region is disposed in a portion of the first cavity that is not visible through the window from an outside of the solid insulation housing.

16. The power distribution switchgear assembly of claim 15, wherein the window has an outer flange portion that defines a first sidewall of the groove, and wherein the solid insulation housing has a recess around the periphery of the first external opening that defines a second sidewall of the groove.

17. The power distribution switchgear assembly of claim 15, further comprising an expansion seal member, a spring seat, and a spring, the expansion seal member in sliding engagement with the solid insulation housing and having a first side and a second side, wherein the first side is in fluid communication with the first cavity and the second side is in fluid communication with an external environment of the power distribution switchgear assembly for accommodating thermal expansion and contraction of the insulating fluid, and wherein the spring biased between the spring seat and the second side of the expansion seal member, and wherein the spring seat is configured to release from the solid insulation housing in response to high pressure in the first cavity due to vaporization of the insulating fluid during a fault in the disconnect.

18. The power distribution switchgear assembly of claim 17, further comprising a spring seat retaining member and a window retainer member, wherein the window retainer member secures the window to the solid insulation housing with a first fastening strength, and wherein the spring seat retaining member secures the spring seat to the solid insulation housing with a second fastening strength that is less than the first fastening strength.

19. The power distribution switchgear assembly of claim 15, further comprising a temperature compensation assembly configured to release from a fastened position in the solid insulation housing and to expel vaporized insulation fluid away from a viewing direction in which a viewer is able to see the moving contact of the disconnect through the window.

20. A pole unit for power distribution, the pole unit comprising:

a solid insulation housing that defines a first external opening and a first cavity extending into the solid insulation housing from the first external opening;

a disconnect having a moving contact in selective engagement with a stationary contact in the first cavity;

a window secured to the solid insulation housing at the first external opening; and an insulating fluid disposed within the first cavity; and a temperature compensation assembly configured to release from a fastened position in the pole unit and expel vaporized insulation fluid away from a viewing direction through the window in response to a fault in the disconnect.

* * * * *